US005152209A

United States Patent [19]

Berger

[11] Patent Number: 5,152,209

[45] Date of Patent: Oct. 6, 1992

[54] ROTARY PUNCHING MACHINE

[75] Inventor: Horst Berger, Glückstadt, Fed. Rep. of Germany

[73] Assignee: Schober GmbH Werkzeug- und Maschinenbau, Fed. Rep. of Germany

[21] Appl. No.: 646,766

[22] PCT Filed: Aug. 1, 1989

[86] PCT No.: PCT/DE89/00502

§ 371 Date: Jan. 16, 1991

§ 102(e) Date: Jan. 16, 1991

[87] PCT Pub. No.: WO90/01381

PCT Pub. Date: Feb. 22, 1990

[30] Foreign Application Priority Data

Aug. 10, 1988 [DE] Fed. Rep. of Germany ..... 3827077

[51] Int. Cl.[5] ..... B26F 1/14; B21D 28/36

[52] U.S. Cl. ..... 83/670; 83/687

[58] Field of Search ..... 83/669, 670, 698, 687, 83/345, 690

[56] References Cited

U.S. PATENT DOCUMENTS

| | | | |
|---|---|---|---|
| 3,106,859 | 10/1963 | Huffman | 83/670 X |
| 3,194,095 | 7/1965 | Buck et al. . | |
| 3,205,744 | 9/1965 | Huck | 83/670 X |
| 3,381,560 | 5/1968 | Mages | 83/669 X |
| 3,813,977 | 6/1974 | Hibbing et al. | 83/670 X |
| 4,108,033 | 8/1978 | Bembenk | 83/670 X |
| 4,548,113 | 10/1985 | Topperwien et al. | 83/670 X |
| 4,613,321 | 9/1986 | Kesten | 83/303 X |
| 4,688,459 | 8/1987 | Osborn et la. | 83/698 |

FOREIGN PATENT DOCUMENTS

| | | |
|---|---|---|
| 0015580 | 9/1980 | European Pat. Off. . |
| 164003 | 11/1905 | Fed. Rep. of Germany . |
| 627356 | 3/1936 | Fed. Rep. of Germany . |
| 1527963 | 6/1971 | Fed. Rep. of Germany . |

*Primary Examiner*—Douglas D. Watts
*Assistant Examiner*—Rinaldi Rada
*Attorney, Agent, or Firm*—Griffin Branigan & Butler

[57] ABSTRACT

A rotary punching machine comprises a pair of punching tools, namely a rotary punching tool with punches arranged on its circumference and a rotary counter tool, which co-operates with the latter, with dies in the form of punching bushings arranged on its circumference. One of the punching tools (1) and the counter tool (3) has a radial groove (12) on its circumferential surface between the respective individual punches (2) or the individual punching bushings (4), the depth of the groove being greater than the depth of penetration of the punches (2) into the punching bushings (4).

13 Claims, 2 Drawing Sheets

ROTARY PUNCHING MACHINE

BACKGROUND OF THE INVENTION

The present invention relates to a punching tool arranged in a rotary punching machine, comprising a revolving male tool carrying punches along its periphery and revolving female tool coacting with the male tool and provided with punching bushes disposed about its circumference as die plates.

Punching tools of this type operate at high speeds in known punching machines. If it happens for one reason or other that the punches come out of synchronous engagement with the punching bushes, or that a punch breaks, both the male tool and the female tool normally have to be replaced due to the fact that the circumferential surfaces of these tools, and also the bores in which the punching bushes are received, and often even the bores serving for mounting the punches, have been damaged by punches or broken fragments.

Now, it is the object of the present invention to minimize such damage.

SUMMARY

The invention achieves its object by an arrangement according to which such a male tool and/or a female tool are provided with a groove which extends in the circumferential direction and is recessed radially into the circumferential surface, between the individual punches or the punching bushes, respectively, the depth of the groove being greater than the length of engagement of the punches in the punching bushes.

BRIEF DESCRIPTION OF THE DRAWINGS

Other features of the invention will appear from the following description of one embodiment of the invention, in conjunction with the drawings in which reference characters refer to the same parts throughout the different views. The individual features may be employed in any embodiment of the invention either individually or in any combination.

The drawings are not necessarily to scale, emphasis instead being placed upon illustrating principles of the invention in a clear manner.

DESCRIPTION OF PREFERRED EMBODIMENT

Figure 1:
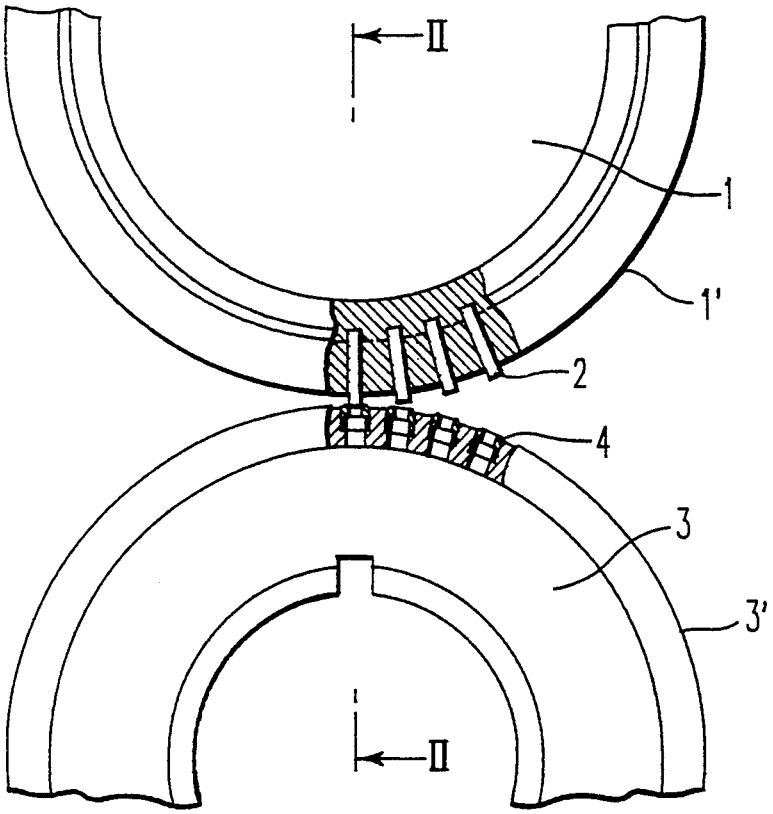
FIG. 1 is a fragmented, side-elevational, view showing a pair of punching tools, partly in section.
Figure 2:
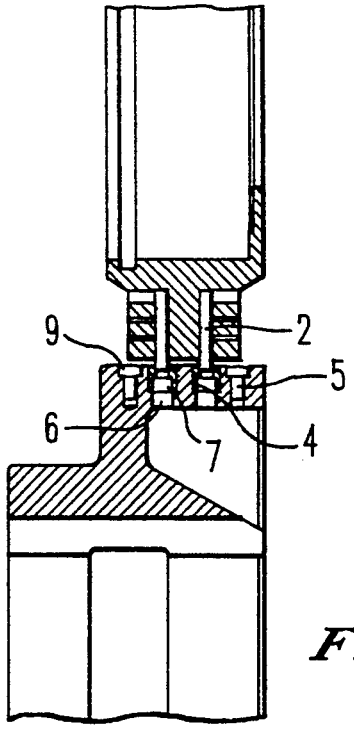
FIG. 2 is a sectional view taken along line II—II in FIG. 1.
Figure 3:
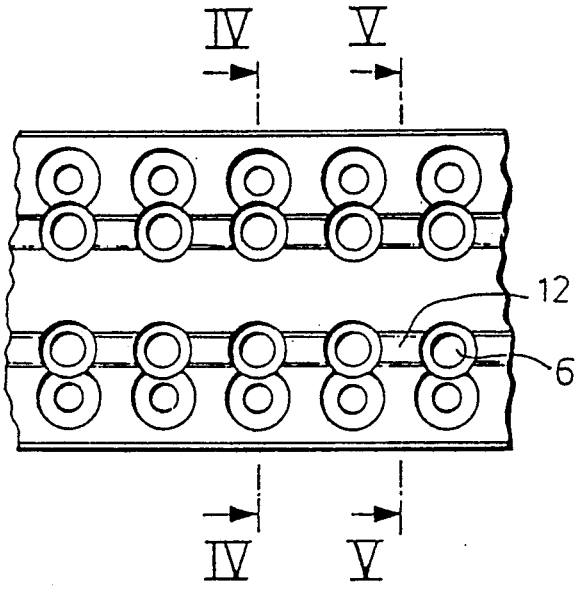
FIG. 3 is a fragmented, top view of a bent-off portion of a circumference of a female tool of this invention containing the punching bushes, in enlarged scale.
Figure 4:
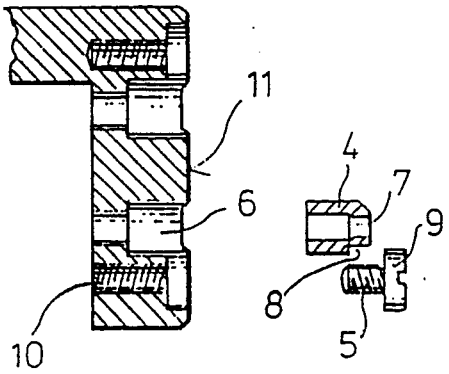
FIG. 4 is an exploded, fragmented, sectional view taken along line IV—IV in FIG. 3.
Figure 5:
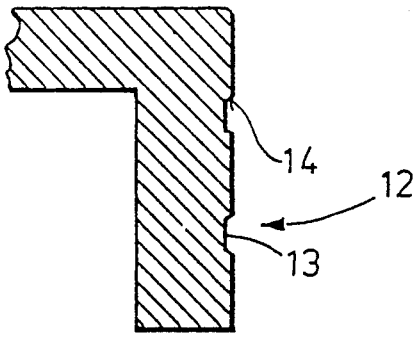
FIG. 5 is a fragmented, sectional view taken along line V—V in FIG. 3.

The embodiment of the invention as illustrated in the drawings comprises radially directed punches 2 mounted rigidly at a periphery of a revolving disk-like male tool 1, extending through a peripheral surface 1' thereof. The way in which the punches are fixed in place is not illustrated in detail, however, as can be seen in FIG. 1, they are separated, or spaced, circumferentially from one another. A female tool 3 cooperating with the male tool 1 is equipped with punching bushes 4 which serve as die plates and which are fixed in a circumferential surface 3' of the female tool 3 by screws 5. The punching bushes 4 are each fitted, or embedded, snugly in a bore 6 below said circumferential surface 3' and each defines a central bore 7 intended for accommodating punches 2 which plunge into the bore over a length of engagement of 0.5 mm, for example. The punching bushes 4, as can be seen in FIG. 1, are separated circumferentially from one another. A shoulder 8 disposed at one point of each punching bush 4 serves for receiving a head 9 of the screw 5 as the latter is screwed into a threaded bore 10 in the female tool. In the mounted condition, when the punching bush 4 is fixed in the bore 6 by the screw 5, the forward, somewhat conical end of the punching bush 4 extends substantially flush with the circumferential surface 11 of the female tool 3.

In the case of the embodiment of the invention illustrated in the drawings, two rows of punches and punching bushes are arranged one beside the other along the circumference of the male tool and the female tool. A groove 12 provided in a circumferential area between and substantially aligned with the bores 6 for receiving the punching bushes 4 and extending in a circumferential direction about the female tool has an axially-directed width somewhat greater than the diameter of the punches 2. A radially-directed depth of the groove 12 is greater than the length of engagement of the punches in the punching bushes 4 and may be equal to, say, 0.6 to 0.8 mm. If a punch breaks, or if the punches come out of synchronized engagement with the punching bushes at very high speeds of the mating tools, then the punching bushes get damaged, not however the remaining parts of the female tool. When the damaged punching bushes have been exchanged, the female tool is again ready for operation. Moreover, the groove 12 is capable of accommodating small fragments without the circumferential surface of the two mating revolving tools suffering greater damage. In any case, the groove 12 acts to reduce the damage caused to the circumference of the two mating tools in the event a punch should break.

According to one embodiment of the invention, the groove exhibits a cross-section tapering inwardly toward the base 13 of the groove, the flanks 14 of the groove being inclined, radially-outwardly diverging, at an angle of approx. 30° to the radial, the width of the groove amounting to 5 mm, for example, at the base 13. The punch diameter may be 4 mm and the bore 7 in the punching bushes may accordingly be equal to 4 mm plus an overmeasure of 0.05 to 0.1 mm.

While the invention has been particularly shown and described with reference to a preferred embodiment, it will be understood by those skilled in the art that various changes in form and detail may be made therein without deporting from the spirit and scope of the invention.

The advantage of the invention is seen in the fact that in case of trouble, i.e. when punches come out of synchronous engagement with punching bushes, it may still happen that the punches run up against the punching bushes whereby the punches and the punching bushes as well may get damaged; however, the bores in which the punches and/or the punching bushes are mounted are not damaged. When the two tools happen to get out of synchronous engagement, the punches project freely into the groove, without hitting against an obstacle. Due to the groove provided between the punches and the punching bushes, the bores receiving the latter are a little recessed so that they cannot be damaged by broken fragments. This permits new or reworked bushes and/or punches to be reinstalled in the bores and does away with the need to scrap the whole tool. As a result, considerable savings in cost and time are achieved.

According to one embodiment of the invention, the width of the groove is greater than the diameter of the punch; by way of example the groove may have a width 20% wider than the diameter of the punch. This is regarded as a good compromise between the aspect that the strength of the tool should be impaired as little as possible by the groove worked radially into the circumferential surface, and the aspect that broken fragments of both punches and bushes should be carried off as efficiently as possible.

According to one embodiment of the invention, the groove has inclined flanks so that the cross-section of the groove gets larger towards the radial outside. The inclined flanks may extend at an angle of 30° to a radial line, for example. This arrangement facilitates both the accommodation of fragments in the groove and their removal from the groove, and the evacuation of the fragments from the groove during rotation of the tool as well.

According to certain embodiments of the invention, the depth of the groove may, for example, equal 1.5 times the length by which the punches engage the punching bushes, that is, the length of the punches which extends into the bushes during engagement.

The invention can be implemented in all cases where tool pairs operate according to a rotary punching method, where die plates and punches rotate in synchronism. The invention is independent of the material processed by the punching machine. Thus it is possible, for example, to install tool pairs according to the invention in printing presses, for perforating paper webs.

The embodiments of the invention in which an exclusive property or privilege are claimed are defined as follows:

I claim:

1. A pair of punching tools arranged in a rotary punching machine, comprising a revolving male tool carrying circumferentially-spaced punches along a radially outwardly-directed peripheral surface thereof and a revolving female tool coacting with the said male tool, having circumferentially-spaced punching bushes embedded at a radially outwardly-directed circumferential surface thereof for acting as die plates for synchronously receiving said punches, which extend through said circumferential surface, thereinto, wherein said female tool is provided with a groove in said circumferential surface which extends in a circumferential direction thereabout and which is recessed radially thereinto, said groove extending circumferentially between and being, circumferentially, substantially aligned with adjacent punching bushes of said female tool, a radial depth of said groove being greater than a length of engagement of said punches in said punching bushes and an axial width of said groove being at least as great as a maximum diameter of those portions of said punches extending into engagement with said punching bushes.

2. A pair of punching tools according to claim 1, wherein said groove has an axially-directed width 20% wider than the diameter of said punches.

3. A pair of punching tools according to claim 2, wherein said groove has inclined, radially-outwardly diverging flanks so that a cross-section of the groove gets larger towards a radial outside.

4. A pair of punching tools according to claim 1, wherein said groove has inclined radially-outwardly diverging flanks so that a cross-section of the groove gets larger towards a radial outside.

5. A pair of punching tools according to claim 4, wherein a depth of said groove equals 1.5 times a maximum length by which said punches can engage said punching bushes.

6. A pair of punching tools according to claim 1, wherein a depth of said groove equals 1.5 times a maximum length by which said punches can engage said punching bushes.

7. A pair of punching tools according to claim 2, wherein a depth of said groove equals 1.5 times a maximum length by which said punches can engage said punching bushes.

8. A pair of punching tools arranged in a rotary punching machine, comprising a revolving male tool carrying circumferentially-spaced punches along a radially outwardly-directed peripheral surface thereof and a revolving female tool coacting with the said male tool, having circumferentially-spaced punching bushes embedded at a radially outwardly-directed circumferential surface thereof for acting as die plates for synchronously receiving said punches, which extend through said circumferential surface, thereinto, wherein at least one of said peripheral surface and said circumferential surfaces defines a groove which extends in a circumferential direction thereabout and which is recessed radially thereinto, said groove extending circumferentially between the respective punches and/or punching bushes of said tool, a radial depth of said groove being greater than a depth of engagement of said punches in said punching bushes and an axial width of said groove being at least as great as a diameter of said punches, wherein said groove has an axially-directed width 20% wider than the diameter of said punches.

9. A pair of punching tools according to claim 8 wherein a depth of said groove equals 1.5 times a maximum depth by which said punches can engage said punching bushes.

10. A pair of punching tools arranged in a rotary punching machine, comprising a revolving male tool carrying circumferentially-spaced punches along a radially outwardly-directed peripheral surface thereof and a revolving female tool coacting with the said male tool, having circumferentially-spaced punching bushes embedded at a radially outwardly-directed circumferential surface thereof for acting as die plates for synchronously receiving said punches, which extend through said circumferential surface, thereinto, wherein at least one of said peripheral surface and said circumferential surfaces defines a groove which extends in a circumferential direction thereabout and which is recessed radially thereinto, said groove extending circumferentially between the respective punches and/or punching bushes of said tool, a radial depth of said groove being greater than a depth of engagement of said punches in said punching bushes and an axial width of said groove being at least as great as a diameter of said punches, wherein said groove has inclined radially-outwardly diverging flanks so that a cross-section of the groove gets larger towards a radial outside.

11. A pair of punching tools according to claim 10 wherein a depth of said groove equals 1.5 times a maximum length by which said punches can engage said punching bushes.

12. A pair of punching tools arranged in a rotary punching machine, comprising a revolving male tool carrying circumferentially-spaced punches along a radially outwardly-directed peripheral surface thereof and a revolving female tool coacting with the said male tool, having circumferentially-spaced punching bushes embedded at a radially outwardly-directed circumferential surface thereof for acting as die plates for synchronously receiving said punches, which extend through said circumferential surface, thereinto, wherein at least one of said peripheral surface and said circumferential surfaces defines a groove which extends in a circumferential direction thereabout and which is recessed radially thereinto, said groove extending circumferentially between the respective punches and/or punching bushes of said tool, a radial depth of said groove being greater than a length of engagement of said punches in said punching bushes and an axial width of said groove being at least as great as a diameter of said punches, wherein a depth of said groove equals 1.5 times a maximum length by which said punches can engage said punching bushes.

13. A pair of punching bushes according to claim 12 wherein said groove has inclined, radially-outwardly diverging flanks so that a cross-section of the groove gets larger towards a radial outside.

* * * * *